US005490471A

United States Patent [19]

Haggerty

[11] Patent Number: 5,490,471

[45] Date of Patent: Feb. 13, 1996

[54] RAFT FOR WHEELCHAIRS

[76] Inventor: Michael P. Haggerty, P.O. Box 322, Spalding, Nebr. 68665

[21] Appl. No.: 357,454

[22] Filed: Dec. 16, 1994

[51] Int. Cl.[6] ..... B63B 1/12

[52] U.S. Cl. ..... 114/61; 114/35

[58] Field of Search ..... 114/61, 35; 440/11; 414/537

[56] References Cited

U.S. PATENT DOCUMENTS

| | | | |
|---|---|---|---|
| 2,341,166 | 2/1944 | Todd | 114/61 |
| 3,818,528 | 6/1974 | Petersen | 414/537 |
| 4,295,236 | 10/1981 | Upchurch | 114/61 |

*Primary Examiner*—Jesus D. Sotelo

*Attorney, Agent, or Firm*—Zarley, McKee, Thomte, Voorhees & Sease; Mark D. Frederiksen

[57] ABSTRACT

A raft for wheelchairs includes a pair of elongated floatable pontoons which are fixed in spaced apart parallel relationship by forward and rearward cross-members. A pair of channel members are mounted between the cross-members, in spaced apart parallel relationship, a distance to receive the wheels of a wheelchair thereon. Preferably, the channel members are oriented parallel to the pontoons, and a pair of ramps are removably connected to one end of the channel members to permit a wheelchair to roll up and on to the raft, as well as exit off the opposite end of the raft. A receiving bracket is mounted to a forward end of the raft and a second receiving bracket is mounted on the rearward end of the raft, to removably receive a motor for powering the raft.

4 Claims, 2 Drawing Sheets

RAFT FOR WHEELCHAIRS

TECHNICAL FIELD

The present invention relates to boats and other water craft, and more particularly to an improved raft for receiving and carrying a wheelchair.

BACKGROUND OF THE INVENTION

While there have been many advances in providing wheelchair bound persons with modified vehicles for travel, and modified recreational vehicles, there has been little done in the way of adapting water craft for wheelchairs.

Basic fishing boats, speed boats, canoes and even row boats require the wheelchair bound person to exit the wheelchair to a separate seat in the boat.

SUMMARY OF THE INVENTION

It is therefore a general object of the present invention to provide an improved raft for wheelchairs.

A further object is to provide a raft for wheelchairs with removable entry and exit ramps.

Still another object of the present invention is to provide a raft for wheelchairs with apparatus for permitting the attachment of electric or gas motors.

Yet another object is to provide a raft for wheelchairs which is very light weight and easy to handle.

These and other objects of the present invention will be apparent to those skilled in the art.

The raft for wheelchairs of the present invention includes a pair of elongated floatable pontoons which are fixed in spaced apart parallel relationship by forward and rearward cross-members. A pair of channel members are mounted between the cross-members, in spaced apart parallel relationship, a distance to receive the wheels of a wheelchair thereon. Preferably, the channel members are oriented parallel to the pontoons, and a pair of ramps are removably connected to one end of the channel members to permit a wheelchair to roll up and on to the raft, as well as exit off the opposite end of the raft. A receiving bracket is mounted to a forward end of the raft and a second receiving bracket is mounted on the rearward end of the raft, to removably receive a motor for powering the raft.

DESCRIPTION OF THE PREFERRED EMBODIMENT

Figure 1:
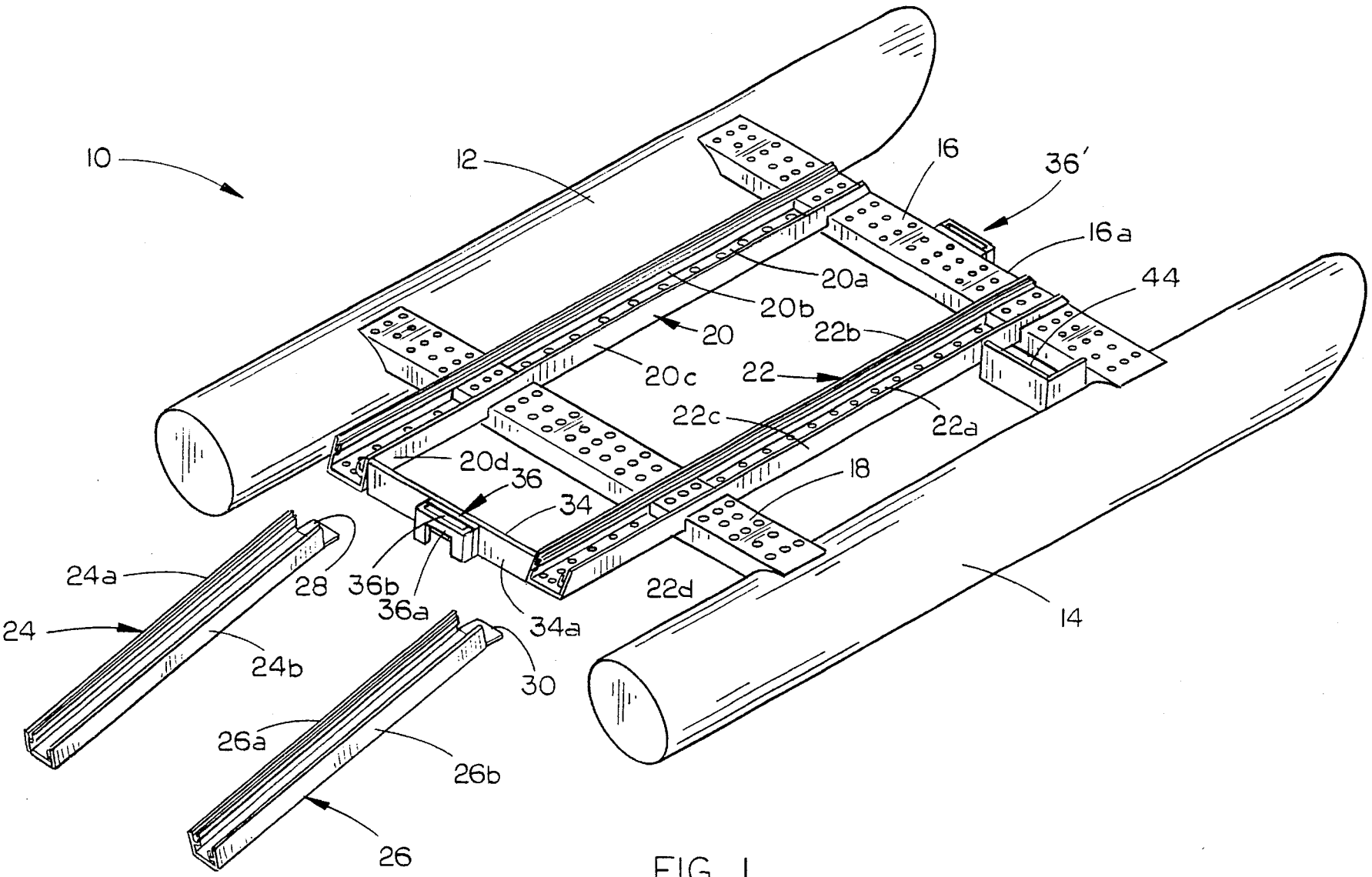
FIG. 1 is a perspective view of the raft of the present invention.

Referring now to the drawings, in which similar or corresponding parts are identified with the same reference numeral, and more particularly to FIG. 1, the raft of the present invention is designated generally at 10 and includes a pair of elongated pontoons 12 and 14, with a pair of forward and rearward cross-members interconnecting the pontoons and affixing them in parallel relationship.

Figure 2:
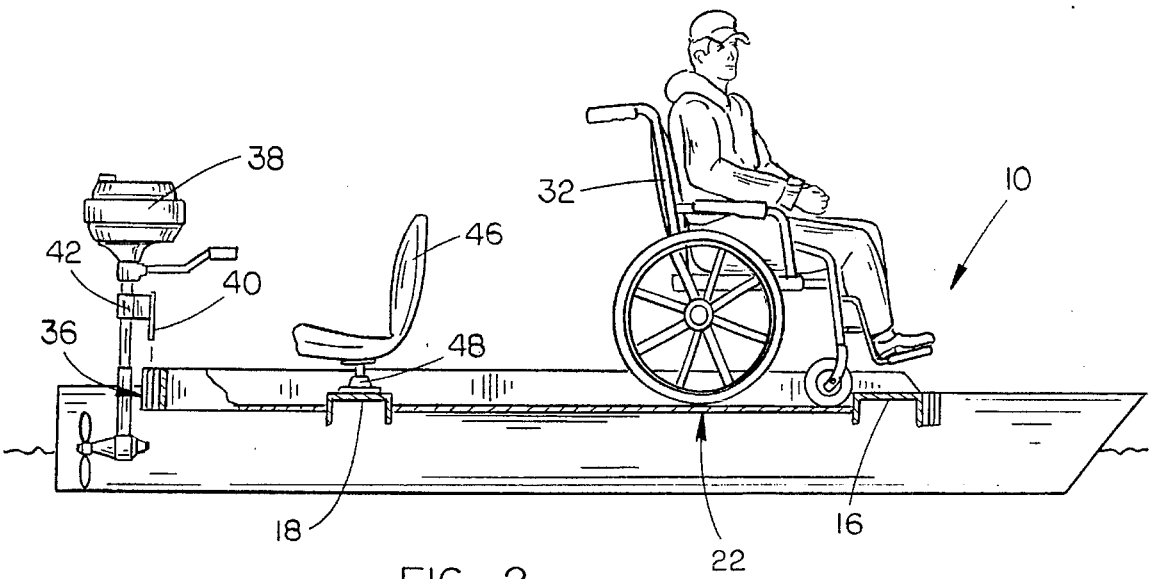
FIG. 2 is a sectional view taken at lines 2—2 in FIG. 1 and with a wheelchair, a seat, and a motor connected thereto.
Figure 3:
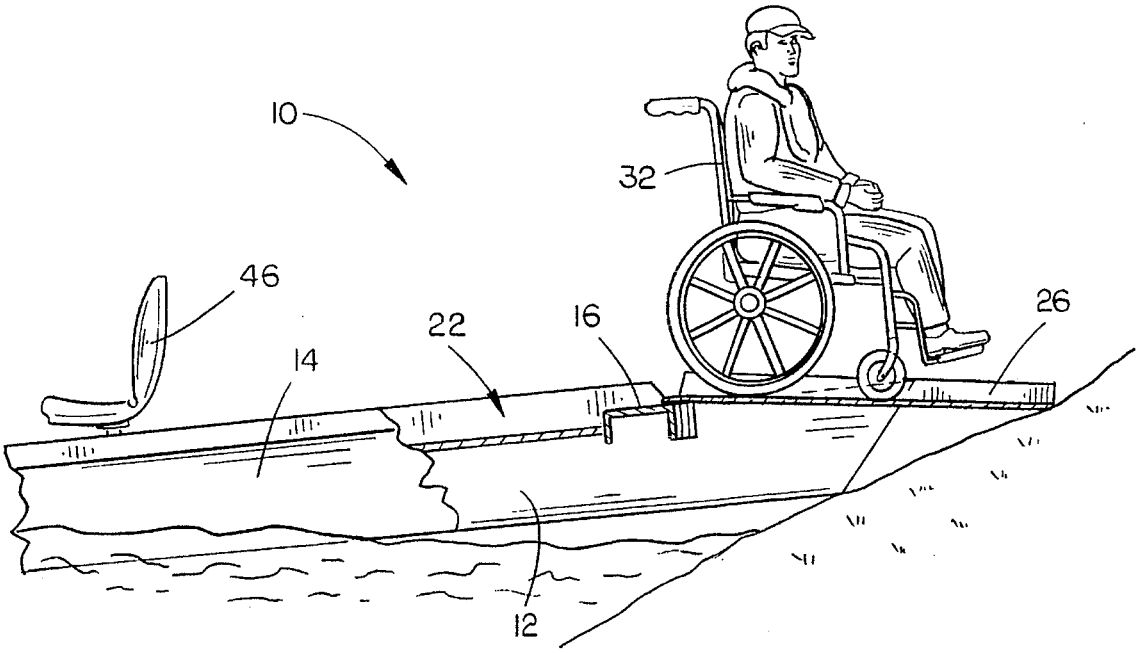
FIG. 3 is an enlarged side elevational view with portions in sectional view, of the present invention.

A pair of elongated channels 20 and 22 are mounted on forward and rearward cross-members 16 and 18 and extend rearwardly beyond rearward cross-member 18. Channels 20 and 22 are parallel and spaced apart, and preferably parallel to pontoons 12 and 14. Channel 20 includes a horizontal base 20*a* and a pair of vertical side members 20*b* and 20*c*, with side members 20*b* and 20*c* spaced apart a distance to receive the width of a standard wheelchair wheel. Similarly, channel 22 includes a base 22*a* and spaced apart side walls 22*b* and 22*c* similar in dimension to channel 20, to receive a wheelchair wheel. Channels 20 and 22 are spaced apart a standard distance to receive the wheels of a wheelchair, as shown in FIGS. 2 and 3.

A pair of elongated ramps 24 and 26 are provided, each having a forwardly projecting support lip 28 and 30, respectively, having a width which permits journaling of lips 28 and 30 within channels 20 and 22. Preferably, ramps 24 and 26 are also channel-shaped members with opposing side walls 24*a* and *b* and 26*a* and *b*, respectively. Ramps 24 and 26 may be utilized on either the forward or rearward ends of channels 20 and 22, to permit a wheelchair 32 to be rolled directly up and into channels 20 and 22, as shown in FIG. 3.

A plate 34 is affixed between the rearward ends 20*d* and 22*d* of channels 20 and 22. A receiving bracket 36 is affixed to a rearward vertical face 34*a* of plate 34. Receiving bracket 36 preferably includes a ring-shaped strap 36*a* with a vertically-oriented opening 36*b* therethrough. As shown in FIG. 2, a conventional motor 38 includes a vertical support plate 40 with a horizontally projecting support arm 42, for supporting motor 38 in receiving bracket 36. Plate 40 is received within opening 36*b* of strap 36*a*, with arm 42 projecting rearwardly on top of strap 36*a* of receiving bracket 36.

A second receiving bracket 36' is mounted in a vertical orientation on a forward face 16*a* of forward cross-member 16, as shown in FIG. 1. Thus, motor 38 may be removably mounted on either the forward or rearward ends of raft 10.

An open topped box 44 is affixed between forward cross-member 16 and channel 22 to receive a battery (not shown) for use with an electric trolling motor or the like. Thus, either a gas engine or an electric motor, or both may be removably installed on raft 10 in receiving brackets 36 and 36'.

As shown in FIG. 2, a seat 46 may be mounted on the upper face of rearward cross-member 18, for an additional passenger. The base 48 of seat 46 is directly mounted to rearward cross-member 18, and seat 46 is removable from base 48, to permit wheelchair 32 access over the top of base 48, during entry or exit from raft 10.

FIG. 1 shows channels 20 and 22 installed with the base 20*a* and 22*a* located vertically below the top surfaces of cross-members 16 and 18. In this way, cross-members 16 and 18 serve as "stops" for the wheels of a wheelchair, as shown in FIG. 2.

In operation, a wheelchair may access raft 10 by aligning ramps 24 and 26 with channels 20 and 22 on either the forward or rearward ends of the channels 20 and 22. Once the wheelchair has rolled up and into channels 20 and 22, ramps 24 and 26 are removed and either stored on the raft or on shore. A motor may be attached in receiving bracket 36 and 36' to power the raft, or a paddle may be utilized by the occupant of the wheelchair.

When it is desired to return to shore, the opposite end of the raft is grounded on the shore, and the wheelchair may proceed directly forwardly off of the raft and down ramps 24 and 26.

Whereas the invention has been shown and described in connection with the preferred embodiment thereof, many modifications, substitutions and additions may be made which are within the intended broad scope of the appended claims.

I claim:

1. A raft for wheelchairs, comprising:

a pair of elongated pontoons floatable on water and affixed in spaced-apart parallel relationship by forward and rearward cross-members affixed between the pontoons;

a pair of channel members, each having a base, opposing vertical side walls, and forward and rearward ends, mounted on said cross-members and extending therebetween in spaced-apart parallel relationship parallel to said pontoons;

said channel members having a width between side walls and being spread apart a distance to receive wheels of a wheelchair thereon, to support a wheelchair on the raft;

a pair of elongated ramps, each ramp having a first end with means for removably connecting the ramp to the ends of a channel;

each ramp having a channel shape, with a base and a pair of opposing side walls;

each ramp having a width between the side walls to receive the wheels of a wheelchair;

a first receiving bracket mounted between the rearward ends of said channels, for removably receiving a support arm attached to a motor for powering the raft in water;

a second receiving bracket mounted between the forward ends of said channels, for removably receiving a support arm attached to a motor for powering the raft in water;

each of said first and second receiving brackets including a generally ring-shaped strap having a vertically-oriented opening extending therethrough for receiving a depending support arm attached to a motor.

2. The raft of claim 1, wherein said strap opening is generally rectangular in shape, to receive a rectangular-shaped support arm therein and prevent rotation of the support arm about a vertical axis.

3. The raft of claim 1, wherein each said channel member has a forward and rearward transversely-oriented notch formed in the base and extending upwardly into the side walls, and wherein said forward and rearward cross-members are received within the associated forward and rearward notches and project upwardly into said channels above the base, to form wheel stops in said channels.

4. The raft of claim 1, wherein each of said ramps includes a generally planar support lip attached to and extending forwardly from the base portion of each said ramp, each support lip having a width less than the distance between the sidewalls of an associated channel for receipt on the base of the associated channel.

* * * * *